US008176894B2

(12) United States Patent
Ulrey et al.

(10) Patent No.: US 8,176,894 B2
(45) Date of Patent: May 15, 2012

(54) VACUUM SYSTEM FOR AN ENGINE

(75) Inventors: Joseph Norman Ulrey, Dearborn, MI (US); Ross Dykstra Pursifull, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 13/240,716

(22) Filed: Sep. 22, 2011

(65) Prior Publication Data

US 2012/0024261 A1 Feb. 2, 2012

(51) Int. Cl.
*F02D 9/10* (2006.01)
*F02M 25/06* (2006.01)

(52) U.S. Cl. ..... 123/336

(58) Field of Classification Search ..... 123/336, 123/337, 360, 399, 339.28
See application file for complete search history.

(56) References Cited

U.S. PATENT DOCUMENTS 4,198,940 A * 4/1980 Ishida ..... 123/568.2
4,523,560 A * 6/1985 Motosugi et al. ..... 123/432
5,121,734 A 6/1992 Grieshaber et al.
5,377,650 A * 1/1995 Warner ..... 123/568.29
5,517,976 A 5/1996 Bachle et al.
5,649,512 A * 7/1997 Flanery et al. ..... 123/339.27
6,543,230 B1 4/2003 Schmid
6,789,531 B1 9/2004 Remmels
7,743,744 B2 6/2010 Ichikawa
2005/0120991 A1 6/2005 Neuschwander et al.
2008/0103667 A1 5/2008 Suzuki et al.
2009/0183500 A1 7/2009 Uchida et al.
2011/0017171 A1 1/2011 Ochiai et al.

* cited by examiner

*Primary Examiner* — Hieu T Vo

(74) *Attorney, Agent, or Firm* — Allan J. Lippa; Alleman Hall McCoy Russell & Tuttle LLP

(57) ABSTRACT

Systems and methods for generating a vacuum in an engine are provided. The system includes a first throttle upstream from a plurality of cylinders and a second throttle upstream from one of the cylinders. The system further includes a vacuum reservoir in fluidic communication with an intake runner downstream from the second throttle; a vacuum consumer in fluidic communication with the vacuum reservoir, the vacuum consumer controlled by an actuator; and a pneumatic actuator driven by a pressure state of the vacuum reservoir to adjust the second throttle.

20 Claims, 5 Drawing Sheets

VACUUM SYSTEM FOR AN ENGINE

BACKGROUND AND SUMMARY

Vehicles may use a vacuum pump to provide negative pressure to drive various features of an internal combustion engine. For example, a vacuum may be utilized to drive various actuators coupled to various systems and/or engine components such as cabin climate controls, a braking system with pneumatic boost, front axle engagement for a four wheel drive system, wastegate valves, compressor bypass valves, intake manifold air control valves, and/or other systems and accessories. Further, a vacuum may be used for crankcase ventilation, vacuum leak-down testing, and fuel vapor purging.

For example, US 2008/0103667 describes a negative pressure control apparatus that allows for a vehicle braking operation. The system includes a throttle valve in each branched intake air passage for supplying air to respective engine cylinders. Each of the throttle valves are linked to a common shaft so that the throttle valves integrally rotate as a collective unit. The apparatus also includes an air ejector that functions as a vacuum pump to drive the negative pressure generated downstream from the throttle valves. Further, the apparatus includes a communication passage to provide a passage for the negative pressure to a brake booster.

The inventors herein have recognized various issues with the above system. In particular, the negative pressure control apparatus can only generate a vacuum at low engine load. Since each intake passage includes a throttle valve that is also responsible for adjusting the intake air for each cylinder, at high engine load, increasing the intake air for combustion takes precedence over decreasing the throttle angle for generating a vacuum. Therefore, vacuum cannot be generated at high engine load using the negative pressure control apparatus described in the above identified patent application. Further, an electrical control unit (ECU) is coupled to the negative pressure control apparatus to actuate the common shaft during low engine load to generate vacuum.

As such, one example approach to address the above issues is to throttle less than all cylinders to generate a vacuum such that vacuum can be generated regardless of the engine operating condition. For example, by utilizing an engine with both a main throttle to regulate intake air to a plurality of cylinders and a port throttle to adjust the airflow to one cylinder, a vacuum can be generated at any engine operating condition, including low engine load and high engine load. In this way, one cylinder downstream from the port throttle may function as both a combustion cylinder, and nominally, as a vacuum pump, in some embodiments. By using the cylinder as the vacuum pump, it is possible to generate a vacuum without including a traditional vacuum pump; however a vacuum pump may be included, if desired. As such, due to the dual functionality of the cylinder the engine weight may be reduced.

Further, the vacuum system may be a self-sustaining vacuum system that functions independently from an ECU. Specifically, the vacuum system may generate a vacuum downstream from the port throttle and capture the vacuum within a reservoir. This configuration enables the reservoir to distribute the vacuum to various vacuum consumers. Further, by taking advantage of pneumatically linking the reservoir to a vacuum actuator responsible for adjusting the port throttle of the one cylinder, a pressure state of the vacuum reservoir serves as a driving force for the vacuum actuator. In this way, it is possible to achieve a vacuum system driven by pneumatics rather than relying upon sensors to transmit electronic signals for actuation.

Note that various valves may be utilized to further direct airflow. Further, the self-sustaining vacuum system may include one or more sensors to evaluate the airflow downstream from the port throttle, if desired.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The following description relates to a vacuum system that includes a port throttle for adjusting airflow to at least one cylinder of a multi-cylinder engine. The vacuum system is arranged in such a way that a vacuum is generated downstream from the port throttle. Further, the vacuum system is driven pneumatically and thus the vacuum system passively generates a vacuum without communicating with a controller. By providing a vacuum reservoir in communication with an intake runner region downstream from the port throttle, the generated vacuum may be stored and supplied to various vacuum consumers, wherein each vacuum consumer may be coupled to another system, to at least in part, operate said system. This arrangement allows for a vacuum to be supplied to various vacuum consumers without relying upon sensors to detect a demand for the vacuum and thus without sending signals via a controller to actuate a vacuum pump. Instead, this arrangement allows the cylinder downstream from the port throttle to act as a pump to generate the vacuum. As such, this system allows for a simplified design and eliminates the need for a traditional vacuum pump. Various valves and sensors may be included in the disclosed system to further regulate airflow. For example, a check valve may be positioned between the intake runner downstream from the port throttle and the vacuum reservoir to enable unidirectional airflow from the reservoir to the intake runner, and inhibiting airflow in the reverse direction. Further, the system may include a manifold air pressure (MAP) sensor dedicated to sampling the air in the intake runner downstream from the port throttle, if desired. When such a MAP sensor is included, it may additionally serve as a secondary MAP sensor to a primary MAP sensor positioned upstream from a plurality of cylinders. In this way, the MAP sensor downstream from the port throttle may be used as a backup sensor to estimate an air pressure of the other cylinders in order to meter an appropriate amount of fuel to the other cylinders, in the event that the primary MAP sensor fails.

Figure 1:
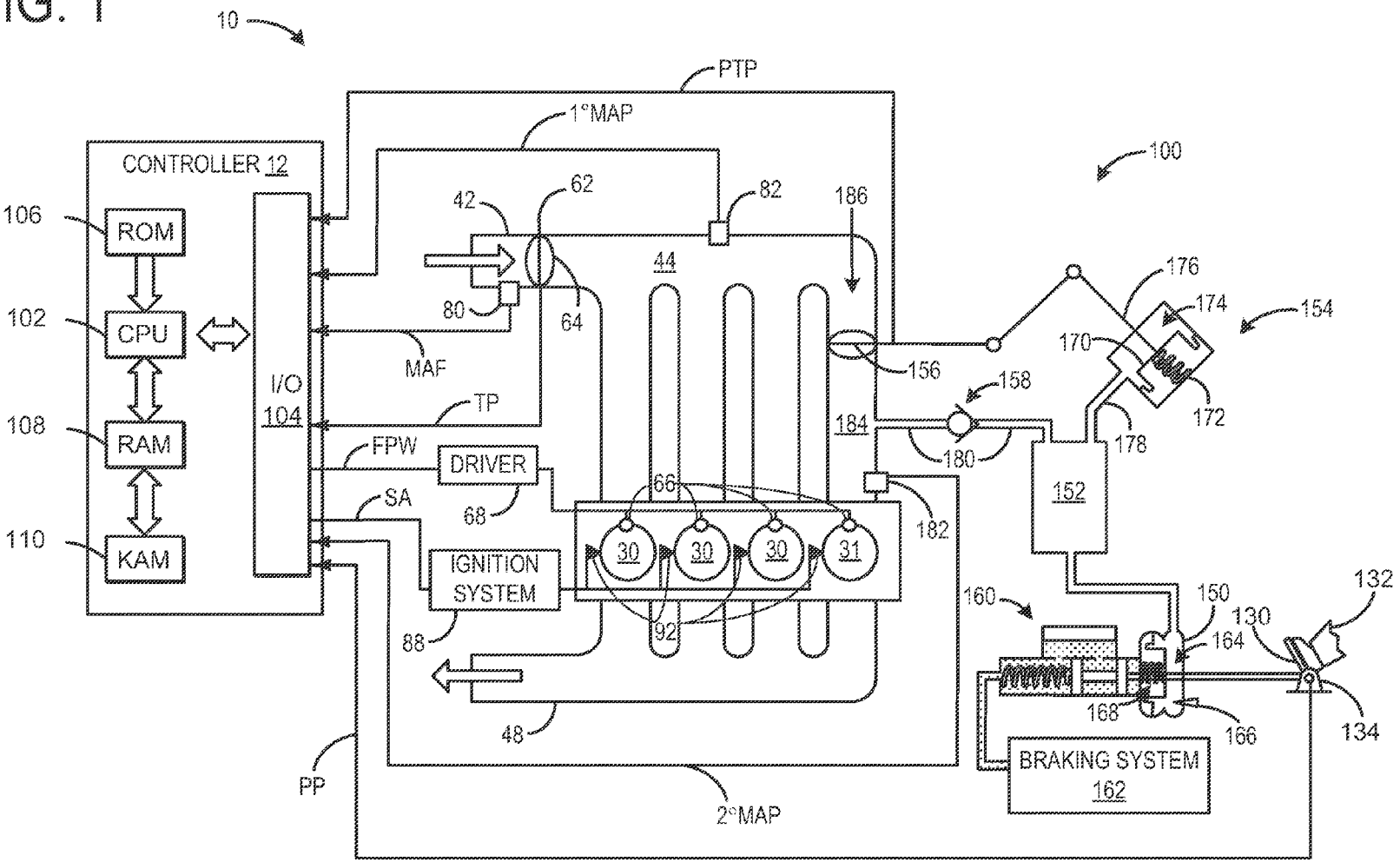
FIG. 1 shows a schematic diagram of an example engine including a vacuum system.

FIG. 1 shows a schematic diagram of an example multi-cylinder internal combustion engine 10. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP.

As shown, engine 10 may include a plurality of combustion cylinders 30 and combustion cylinder 31. Each cylinder may include combustion cylinder walls with a piston positioned therein. The pistons may be coupled to a crankshaft so that reciprocating motion of the pistons is translated into rotational motion of the crankshaft. The crankshaft may be coupled to at least one drive wheel of a vehicle via an intermediate transmission system. Further, a starter motor may be coupled to the crankshaft via a flywheel to enable a starting operation of engine 10.

Combustion cylinders 30 and 31 may receive intake air from intake manifold 44 via intake passage 42 and may exhaust combustion gases via exhaust passage 48. Intake manifold 44 and exhaust passage 48 can selectively communicate with combustion cylinders 30 and 31 via an intake valve (not shown) and an exhaust valve (not shown), respectively, for each cylinder. In some embodiments, each combustion cylinder may include two or more intake valves and/or two or more exhaust valves. Additionally or alternatively, at least one combustion cylinder, such as cylinder 31, may be configured to receive air from a vacuum consumer 150, as described in more detail below. It will be appreciated that combustion cylinder 31 is similar to combustion cylinders 30, and therefore may include similar features as combustion cylinders 30.

It will be appreciated that the intake valve(s) and exhaust valve(s) for each cylinder may be controlled by cam actuation. Cam actuation systems may each include one or more cams and may utilize one or more of cam profile switching (CPS), variable cam timing (VCT), variable valve timing (VVT) and/or variable valve lift (VVL) systems that may be operated by controller 12 to vary valve operation. The position of the intake valves and exhaust valves may be determined by position sensors. In alternative embodiments, intake valves and/or exhaust valves may be controlled by electric valve actuation. For example, cylinder 30 may alternatively include an intake valve controlled via electric valve actuation and an exhaust valve controlled via cam actuation including CPS and/or VCT systems.

Fuel injectors 66 are shown coupled directly to combustion cylinders 30 and 31 for injecting fuel directly therein in proportion to the pulse width of signal FPW received from controller 12 via electronic driver 68. In this manner, fuel injectors 66 provide what is known as direct injection of fuel into combustion cylinders 30 and 31. The fuel injectors may be mounted on the side of the combustion cylinders or in the top of the combustion cylinders, for example. Fuel may be delivered to fuel injectors 66 by a fuel delivery system (not shown) including a fuel tank, a fuel pump, and a fuel rail. In some embodiments, combustion cylinders 30 and 31 may alternatively or additionally include a fuel injector arranged in intake passage 42 in a configuration that provides what is known as port injection of fuel into the intake port upstream of combustion cylinder 30.

Intake passage 42 may include a throttle 62 having a throttle plate 64. In this particular example, the position of throttle plate 64 may be varied by controller 12 via a signal provided to an electric motor or actuator included with throttle 62, a configuration that may be referred to as electronic throttle control (ETC). In this manner, throttle 62 may be operated to vary the intake air provided to combustion cylinders 30 and 31. Intake passage 42 may include a mass air flow sensor 80 and a manifold air pressure (MAP) sensor 82 for providing respective signals to controller 12. Further, an additional MAP sensor 182 may be provided in an intake runner upstream from combustion cylinder 31 for providing a signal to controller 12. MAP sensor 82 may be a primary MAP sensor and MAP sensor 182 may be a secondary MAP sensor, as described in more detail below. While not shown, it will be appreciated that intake passage 42 may further include a charge motion control valve (CMCV) and CMCV plate.

Ignition system 88 can provide an ignition spark to combustion cylinders 30 and 31 via spark plugs 92 in response to spark advance signal SA from controller 12, under select operating modes. Though spark ignition components are shown, in some embodiments, one or more of combustion chambers 30 and 31 may be operated in a compression ignition mode, with or without an ignition spark.

Exhaust passage 48 is shown in simplified form and may further include an exhaust gas sensor for providing an indication of exhaust gas air/fuel ratio such as a linear oxygen sensor or UEGO (universal or wide-range exhaust gas oxygen), a two-state oxygen sensor or EGO, a HEGO (heated EGO), a $NO_x$, HC, or CO sensor. The exhaust system may further include light-off catalysts and underbody catalysts, as well as exhaust manifold, upstream and/or downstream air-fuel ratio sensors. Further, the exhaust system may include a catalytic converter which may include multiple catalyst bricks, in one example. In another example, multiple emission control devices, each with multiple bricks, can be used. Further, the catalytic converter may be a three-way type catalyst, for example.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. The controller 12 may receive various signals and information from sensors coupled to engine 10, in addition to those signals previously discussed, including measurement of inducted mass air flow (MAF) from mass air flow sensor 120; engine coolant temperature (ECT) from a temperature sensor coupled to a cooling sleeve; a profile ignition pickup signal (PIP) from a Hall effect sensor (or other type) coupled to the crankshaft; throttle position (TP) from a throttle position sensor; and absolute manifold pressure signal, MAP, from sensors 82 and 182. Storage medium read-only memory 106 can be programmed with computer readable data representing instructions executable by processor 102 for performing the methods described below as well as variations thereof.

Engine 10 may include a vacuum system 100 for generating a vacuum to provide to various vacuum consumers. For example, negative pressure may be consumed by an actuator to drive one or more of a cabin climate control system, a braking system with pneumatic boost, front axle engagement on four wheel drive systems, wastegate valves, compressor bypass valves, intake manifold air control valves, and/or other accessories. The particular configuration of vacuum system 100 may allow the system to be pneumatically driven such that the system may be operate without sending/receiving signals to/from controller 12. In this way, vacuum system 100 may be self-sustaining and function independently from controller 12 to passively generate a vacuum for consumption by another system of engine 10.

As shown in FIG. 1, vacuum system 100 may include one or more vacuum consumers 150, a vacuum reservoir 152, a pneumatic actuator 154, a port throttle 156, and a valve 158.

In the example provided, vacuum consumer 150 may be a brake booster coupled to a hydraulic actuator 160 for intensifying a braking force applied by vehicle operator 132 to engage braking system 162. As a vacuum consumer, the brake booster may be operated at least in part by a vacuum supply. For example, a vacuum supply may retain hydraulic actuator 160 in a resting position in the absence of external forces. However, when a vehicle operator depresses brake pedal 130 a chamber 164 of brake booster 150 may open to the atmosphere thus increasing the pressure within the chamber. For example, an air valve 166 may open to the atmosphere. In this way, a braking force initiated by operator 132 may be magnified, a process often associated with power brakes. Since the brake booster is in fluidic communication with vacuum reservoir 152, atmospheric pressure is also introduced into vacuum reservoir 152 thus increasing the pressure state of vacuum reservoir 152 when the brake pedal is depressed. However, when operator 132 releases brake pedal 130, air valve 166 closes and air chamber 164 approaches equilibrium with air chamber 168, and braking system 162 returns to the resting state. Due to vacuum system 100, air chamber 164 may return to a low pressure state, as described in more detail below.

It will be appreciated that brake booster 150 is provided by way of example and is not meant to be limiting. As such, other vacuum consumers are possible without departing from the scope of this disclosure.

Further, it will be appreciated that the one or more vacuum consumers may be coupled to an actuator, such as hydraulic actuator 160. As such, the one or more vacuum consumers may operate independently from the vacuum system with the exception of having access to the vacuum supply. In some embodiments, one or more vacuum consumers may be in electronic communication with controller 12.

Vacuum reservoir 152 may be a reservoir for storing a vacuum, for example. Further, since vacuum reservoir 152 may provide the vacuum to one or more vacuum consumers 150, vacuum reservoir 152 may transiently store the vacuum. Therefore a pressure state of vacuum reservoir 152 may depend on the operational state of the various vacuum consumers 150. For example, vacuum reservoir 152 may be in a low pressure state (i.e., storing a vacuum) when vacuum consumer 150 is under vacuum. As described above, vacuum reservoir 152 may be in the low pressure state when braking system 162 is in the resting state. Furthermore, vacuum reservoir 152 may be in a higher pressure state when the vacuum is consumed and replaced with high pressure airflow from the vacuum consumers. As described above, vacuum reservoir 152 may be in the high pressure state when the brake booster is open to the atmosphere thus engaging braking system 162. In this way, vacuum reservoir 152 may be in a negative pressure state when storing a vacuum and in a positive pressure state when the vacuum is consumed.

In some embodiments, the vacuum reservoir may be integral with the vacuum consumer. In other words, the vacuum reservoir may be contiguous with the vacuum consumer. Said in another way, the vacuum consumer may also be the vacuum reservoir. For example, a brake booster may be both a vacuum consumer and a vacuum reservoir, which is provided as one non-limiting example.

Further, the pressure state of vacuum reservoir 152 may determine a position of port throttle 156 by stimulating pneumatic actuator 154. Therefore, pneumatic actuator 154 may be responsive to the pressure state of vacuum reservoir 152 to actuate port throttle 156 since the port throttle is mechanically linked to pneumatic actuator 154. In this way, vacuum reservoir 152 may be in fluidic communication with pneumatic actuator 154 to adjust the position of port throttle 156. In other words, the pressure state of vacuum reservoir 152 may determine a throttle angle of port throttle 156.

It will be appreciated that port throttle 156 may be actuated in other ways. For example, port throttle 156 may be configured for electronic throttle control. As another example, port throttle 156 may be actuated mechanically in other ways aside from pneumatic actuation. For example, port throttle 156 may be coupled to a hydraulic actuator.

Pneumatic actuator 154 may be configured to convert energy into motion, wherein the energy source is in the form of compressed air. For example, pneumatic actuator 154 may be a diaphragm actuator. Thus, pneumatic actuator 154 may include a diaphragm 170, a spring return 172, an air chamber 174 and a spindle 176.

During a resting state, air chamber 174 may be at or near atmospheric pressure, for example. In such cases, diaphragm 170, spring return 172, and spindle 176 may also be in a resting position. Since pneumatic actuator 154 is mechanically linked to port throttle 156 via spindle 176, the resting position may correspond to the port throttle in an open position, for example. In other words, when the pneumatic actuator is in the resting state, the spring return may not compress, and a position of the port throttle may correspond to a wide open throttle position, for example.

During operation, compressed air may enter air chamber 174 via air passage 178 increasing the pressure inside air chamber 174. The resulting increase in pressure may compress spring return 172 and likewise move diaphragm 170 in a direction corresponding with the spring compression. Such a compression may further move spindle 176 in the compression direction. Since pneumatic actuator 154 is mechanically linked to port throttle 156, movement of spindle 176 may result in an adjustment of a position of port throttle 156. In other words, a throttle angle of port throttle 156 may change in response to an increased pressure within air chamber 174. For example, increased pressure within air chamber 174 may correspond to closing port throttle 156. It will be appreciated that port throttle 156 may be adjusted to a near closed position in response to the increased pressure within air chamber 174. In other words, airflow from intake manifold 44 may leak around port throttle 156 in such a scenario. However, it is to be understood that the airflow from intake manifold 44 is largely obstructed due to the near closed position of port throttle 156.

Since pneumatic actuator 154 responds to the particular pressure state of vacuum reservoir 152, when the vacuum supply is consumed by vacuum consumer 150, pneumatic actuator 154 returns to the resting state. As such, return spring 172 may no longer be forced into the compressed state. Therefore, the position of port throttle 156 may return to wide open throttle, thus enabling airflow from the intake manifold 44 to a region downstream from port throttle 156. In such a scenario, the airflow from intake manifold 44 is largely unobstructed by port throttle 156.

It will be appreciated that pneumatic actuator 154 may be configured as a spring-to-retract actuator or as a spring-to-extend actuator without departing from the scope of this disclosure. Further, it will be appreciated that the diaphragm actuator is provided as one example, and other actuators are possible. As one example, pneumatic actuator 154 may be a piston actuator.

In this way, the pressure state of vacuum reservoir 152 may determine the position of port throttle 156 via pneumatic actuator 154. Further, the pressure state of vacuum reservoir 152 may also determine a state of valve 158.

Valve 158 may be positioned within air passage 180 between vacuum reservoir 152 and a region 184 downstream from port throttle 156 within an intake runner 186. Alternatively, valve 158 may couple vacuum reservoir 152 to region 184 without an air passage. In other words, valve 158 may directly couple vacuum reservoir 152 to region 184.

Valve 158 may be a check valve such as a ball check valve, for example. As such, check valve 158 may enable unidirectional airflow between vacuum reservoir 152 and region 184. For example, check valve 158 may enable airflow from vacuum reservoir 152 to region 184. In this way, a high pressure state of vacuum reservoir 152 may enable airflow from the vacuum reservoir through air passage 180 to region 184, for example. However, a low pressure state of vacuum reservoir may not overcome a pressure force to open check valve 152. Therefore, the low pressure state of vacuum reservoir 152 may correspond to a closed check valve. In other words, when vacuum reservoir 152 contains a vacuum, check valve 158 may be closed. Therefore, the pressure state of vacuum reservoir 152 may contribute to opening check valve 158 when the pressure inside vacuum reservoir 152 exceeds the pressure within region 184 of intake runner 186. Further, since check valve 158 permits unidirectional flow, it will be appreciated that reverse flow from the intake runner to the vacuum reservoir is not possible even when the pressure of the intake runner exceeds the pressure of the vacuum reservoir.

It will be appreciated that the pressure state of vacuum reservoir 152 may simultaneously affect the pressure state of air chamber 174 of pneumatic actuator 154 and the opening/closing state of check valve 158. Thus, depending on the pressure state of vacuum reservoir 152 airflow to combustion cylinder 31 may originate from intake manifold 44 and/or vacuum consumer 150 by way of vacuum reservoir 152. Further, it will be appreciated that if combustion cylinder 31 receives air from intake manifold 44 and vacuum consumer 150 during an intake stroke that the vacuum consumer contributes a substantially greater percentage of the intake air than intake manifold 44 (i.e., air from intake manifold may leak around port throttle 156).

Further, vacuum system 100 may include MAP sensor 182 for sampling the airflow in region 184. As such, MAP sensor 182 may provide a reading to controller 12 that may be used to adjust the fueling to combustion cylinder 31, if necessary. Therefore, an appropriate amount of fuel for injection into combustion cylinder 31 may be determined. In particular, when combustion cylinder 31 is filled with air from vacuum consumer 150 by way of vacuum reservoir 152, MAP sensor 182 may provide an airflow reading to controller 12. In such a scenario, the reading from MAP sensor 182 may be more accurate than a reading from MAP sensor 82. Further, when combustion cylinder 31 is filled with air from intake manifold 44, MAP sensor 182 may be used additionally or alternatively to MAP sensor 82 in order to meter an appropriate amount of fuel to combustion cylinder 31.

Further, MAP sensor 182 may be used for diagnostic purposes. For example, a reading from MAP sensor 182 may be compared to a reading from MAP sensor 82 to determine if the sensors are functioning properly. For example, if the two readings are within a threshold range of each other, it may be determined that the sensors are functioning properly. However, if the two readings are outside of the threshold range of each other, it may be determined that at least one of the sensors is not functioning properly. Should one sensor fail, the other sensor may be used to estimate the airflow of the one or more other cylinders. For example, should MAP sensor 82 fail, a reading taken by MAP sensor 182 may be sent to controller 12 to estimate the fueling to combustion cylinders 30 as well as combustion cylinder 31. In this way, MAP sensor 182 may be a backup sensor to MAP sensor 82. In other words, MAP sensor 182 may be a secondary sensor to primary MAP sensor 82.

It will be appreciated that vacuum system 100 may include additional sensors to send signals to controller 12, for example, that may be used to synchronize other systems with vacuum system 100. For example, additional sensors may send signals to controller 12 to adjust injection timing, spark timing, cam actuation, etc. However, it is to be understood that vacuum system 100 operates independently from controller 12, as described above.

Further, by providing port throttle 156 within intake runner 186, the resulting configuration may be referred to as a throttle per cylinder arrangement. In this example, the throttle per cylinder corresponds to combustion cylinder 31, whereas the remaining cylinders may not be throttled in addition to throttle 62. However, it will be appreciated that engine 10 may include more than one throttle per cylinder arrangement. In other words, there may be a port throttle positioned within more than one intake runner of engine 10. In this way, there may be more than one source for generating a vacuum to supply to vacuum reservoir 152 for consumption. By throttling one or more cylinders with a port throttle to generate a vacuum and including one or more other cylinders that are throttled by a main throttle for combustion (and not additionally throttled by a port throttle), a vacuum may be generated at any engine operating condition. In other words, a port throttle may be provided in less than all of the cylinders, for example, only one port of a particular cylinder (e.g., cylinder 31) may have a port throttle and other ports of the remaining cylinders may not have a port throttle. However, all cylinders may communicate with a main throttle (e.g., throttle 62).

Further, it will be appreciated that the pressure-volume characteristics of a cylinder without a port throttle may differ from the pressure-volume characteristics of a throttle per cylinder arrangement. For example, the pressure-volume characteristics of combustion cylinders 30 may differ from combustion cylinder 31.

Figure 2:
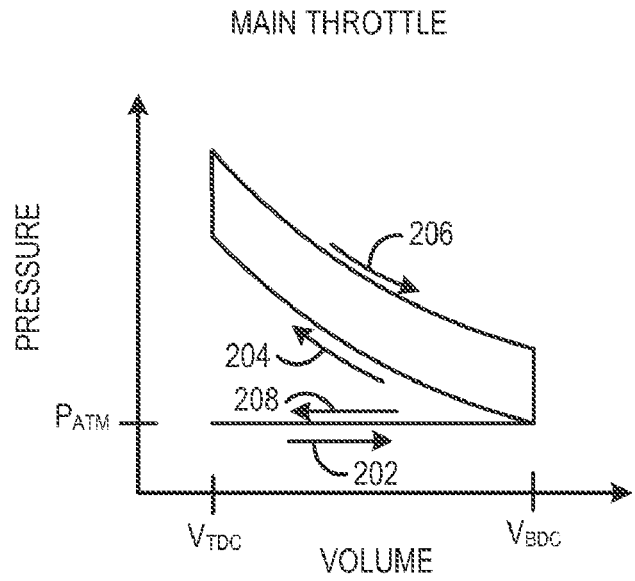
FIG. 2 graphically shows an example pressure-volume diagram for a multi-cylinder engine.

FIG. 2 graphically shows an example pressure-volume diagram 200 for an engine including a main throttle (e.g., throttle 62) for regulating airflow to a plurality of cylinders (e.g., cylinders 30). As shown, pressure-volume diagram 200 illustrates how pressure and volume of a cylinder may change during operation. Typically, each cylinder undergoes a four stroke cycle: the cycle includes the intake stroke, compression stroke, expansion stroke, and exhaust stroke. The pressure and/or the volume of the cylinder changes according to the particular stroke in which the cylinder is operating.

The intake stroke is represented generally by arrow 202. Typically, during the intake stroke, the exhaust valve closes and the intake valve opens. Air is introduced into combustion chamber 30 via intake manifold 44, and the piston moves to the bottom of the cylinder so as to increase the volume within combustion chamber 30. The position at which the piston is near the bottom of the cylinder and at the end of its stroke (e.g. when combustion chamber 30 is at its largest volume) is typically referred to by those of skill in the art as bottom dead center (BDC). As shown, during the intake stroke the pressure remains constant and is approximately equivalent to atmospheric pressure. At a volume corresponding to BDC, the intake valve closes and thus the intake stroke ends.

The compression stroke is represented generally by arrow 204. During the compression stroke, the intake valve and the exhaust valve are closed. The piston moves toward the cylinder head so as to compress the air within combustion chamber 30. The point at which the piston is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by a spark plug, resulting in combustion. In some embodiments, compression ignition may be employed in the engine 10. As shown, during the compression stroke, the pressure increases as the volume of the cylinder decreases towards a volume corresponding to TDC.

The expansion stroke is represented generally by arrow 206. During the expansion stroke, the expanding gases following ignition push the piston back to BDC. The crankshaft converts the piston movement into a rotational torque of the rotary shaft. Thus, during the expansion stroke, the pressure decreases as the volume of the cylinder increases towards a volume corresponding to BDC.

The exhaust stroke is represented generally by arrow 208. During the exhaust stroke, the exhaust valve opens to release the combusted air-fuel mixture to exhaust manifold 48 and the piston returns to TDC. As shown, during the exhaust stroke, the pressure remains constant at approximately atmospheric pressure while the volume of the cylinder decreases as the air-fuel mixture is expelled to exhaust manifold 48. Accordingly, the four stroke cycle repeats with the intake stroke and the operation of the multi-cylinder engine continues.

FIG. 2 shows the pressure-volume diagram of a traditional main throttle multi-cylinder engine. However, a throttle per cylinder engine may result in a different pressure-volume diagram under certain conditions. For example, engine 10 of FIG. 1 may include combustion cylinders 30 that may follow the pressure-volume diagram as depicted in FIG. 2; however, the particular cylinder 31 may result in a different pressure-volume diagram when the port throttle adjusts the airflow entering cylinder 31. In other words, when port throttle 156 is wide open, and thus does not adjust the airflow downstream from throttle 62, the pressure-volume diagram may be similar to pressure-volume diagram 200. However, when port throttle 156 is closed or near closed, and thus adjusts (e.g., at least partially obstructs) the airflow downstream from throttle 62, the resulting pressure-volume diagram for cylinder 31 throttled by port throttle 156 may differ from pressure-volume diagram 200.

Figure 3:
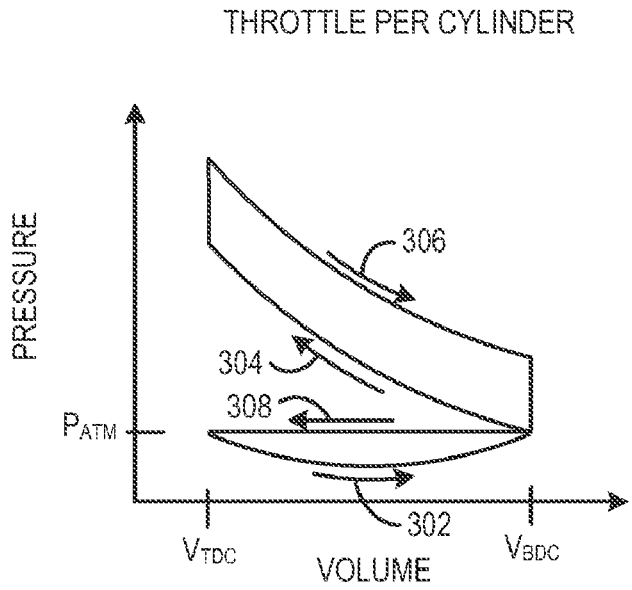
FIG. 3 graphically shows an example pressure-volume diagram for the example engine of FIG. 1.

For example, FIG. 3 graphically shows an example pressure-volume diagram 300 for cylinder 31 that may represent a pressure-volume relationship of the cylinder when port throttle 108 adjusts the airflow downstream from the main throttle (e.g., throttle 62).

The intake stroke is represented generally by arrow 302. Typically, during the intake stroke, the exhaust valve closes and the intake valve opens. Air is introduced into combustion chamber 31 via vacuum consumer 150 by way of vacuum reservoir 152 and check valve 158, as described above. As shown, during such an intake stroke the pressure may dip below atmospheric pressure. Since the airflow from intake manifold 44 may be largely inhibited from surpassing the port throttle when the port throttle is closed or near closed, the piston of cylinder 31 begins the intake stroke by expanding the volume of the cylinder without having, at least initially, an adequate supply of air in which to fill the cylinder. Thus, a negative pressure state results and a vacuum is generated. However, prior to intake valve closure and thus prior to the end of the intake stroke, the pressure returns to atmospheric pressure and the cylinder is filled with an adequate supply of air, wherein the source of the air is vacuum consumer 150. At a volume corresponding to BDC, the intake valve closes and the intake stroke ends.

The inventors herein have recognized that at low engine speeds, the port throttle has very little effect on the corresponding cylinder's air charge (e.g., the air charge of cylinder 31). This observation is primarily due to the relatively long cylinder filling time at low engine speeds. Thus, cylinder 31 may be aired and fueled while the cylinder produces a slightly reduced torque than the rest of the cylinders (e.g., combustion cylinders 30). Since it is the cylinder pressure at intake valve closure that governs the cylinder air charge, a transient high vacuum may occur during the intake stroke but a low vacuum may occur at intake valve closure. Thus, port throttle 156 may be adjusted to a closed or near closed position during the intake stroke. For example, port throttle 156 may be adjusted to a near closed position during a middle period of the intake stroke. Therefore, the cylinder pressure at intake valve closure for pressure-volume diagram 300 may be similar to the cylinder pressure at intake valve closure for pressure-volume diagram 200. However as discussed above, the cylinder pressure during the middle period of the intake stroke may differ between the two diagrams due to the influence of the port throttle.

The compression stroke is represented generally by arrow 304. During the compression stroke, the intake valve and the exhaust valve are closed. The piston moves toward the cylinder head so as to compress the air within combustion chamber 31. As shown, during the compression stroke, the pressure increases as the volume of the cylinder decreases towards a volume corresponding to TDC, similar to pressure-volume diagram 200.

The expansion stroke is represented generally by arrow 306. During the expansion stroke, the expanding gases following ignition push the piston back to BDC. As show, during the expansion stroke, the pressure decreases as the volume of the cylinder increases towards a volume corresponding to BDC, similar to pressure-volume diagram 200.

The exhaust stroke is represented generally by arrow 308. During the exhaust stroke, the exhaust valve opens to release the combusted air-fuel mixture to exhaust manifold 48 and the piston returns to TDC. As shown, during the exhaust stroke, the pressure remains constant at approximately atmospheric pressure while the volume of the cylinder decreases as the air-fuel mixture is expelled to exhaust manifold 48, similar to pressure-volume diagram 200. Accordingly, the four stroke cycle repeats with the intake stroke and the operation of the multi-cylinder engine continues.

In this way, cylinder 31 may operate as a vacuum pump to generate a vacuum within region 184 of intake runner 186. It will be appreciated that a particular cylinder 31 may operate conditionally as a vacuum pump additionally or alternatively to generating torque through combustion. In other words, depending on the throttle angle of the port throttle, cylinder 31 may operate as a vacuum pump and/or as a traditional combustion cylinder. For example, when the port throttle is closed or near closed, cylinder 31 may operate as a vacuum pump and may not be fueled. However, since the vacuum consumer supplies air to region 184 and/or air leaks around a near closed port throttle 156 from intake manifold 44, cylinder 31 may fill with a sufficient amount of air by intake valve closure. Therefore, even when cylinder 31 is operating as a vacuum pump, the charge air may still be ignited. In some embodiments, cylinder 31 may operate as a vacuum pump, and even though cylinder 31 may be filled with a sufficient amount of air by intake valve closure, the cylinder may not be injected with fuel, and thus the cylinder may not be used for combustion. In other words, cylinder 31 may be dedicated to generating a vacuum and as such may not be fueled under any condition.

Figure 4:
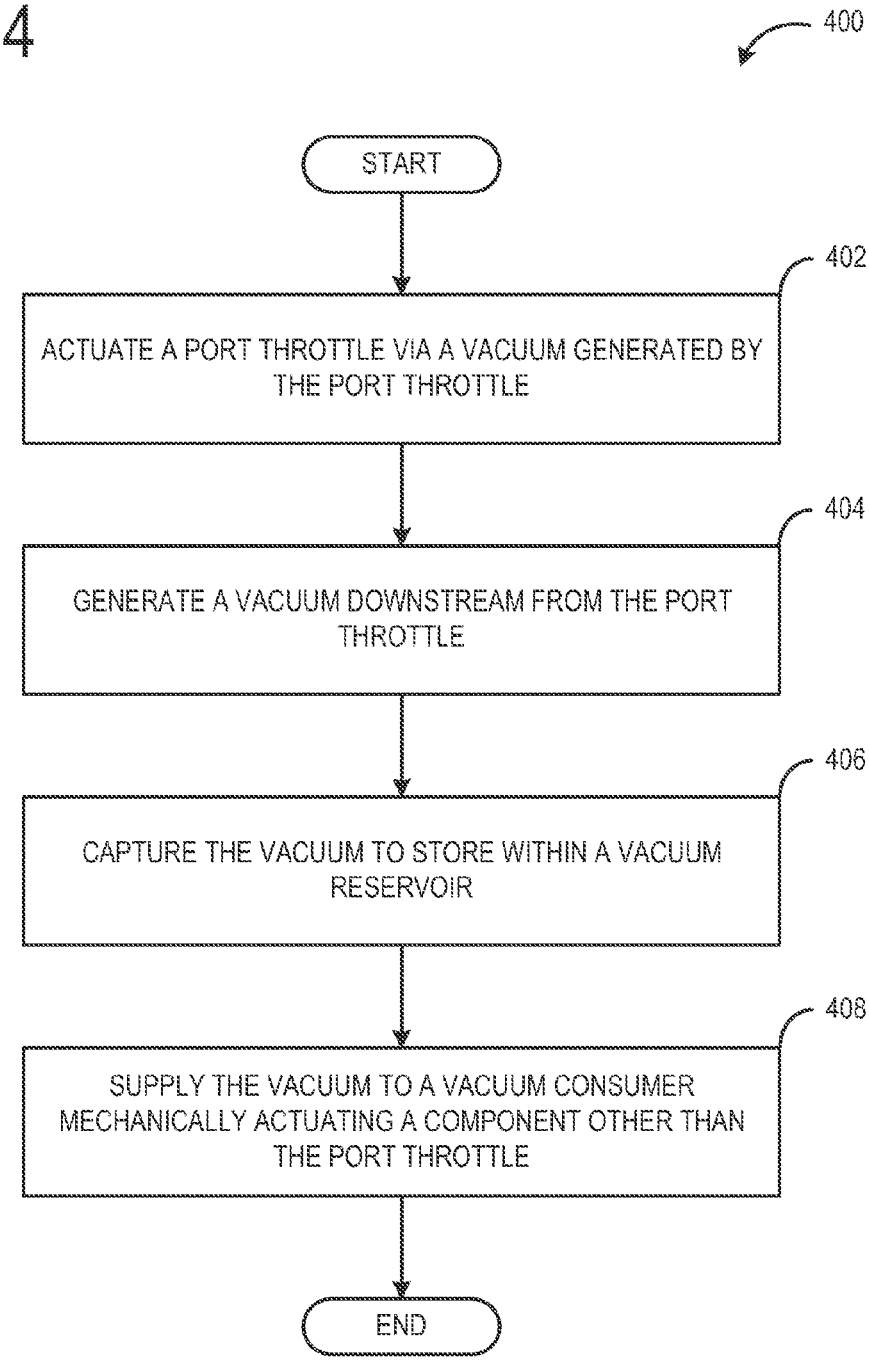
FIG. 4 shows a flowchart of an example method for generating a vacuum in the example engine of FIG. 1.

FIG. 4 shows a flowchart of an example method 400 for generating a vacuum in the example engine of FIG. 1. As described above, vacuum system 100 may operate without a traditional vacuum pump and without receiving signals from a controller. Instead, vacuum system may be driven pneumatically, and as such the system may be self-sustaining to passively generate a vacuum.

At 402, method 400 includes actuating a port throttle via a vacuum generated by the port throttle. For example, actuating the port throttle may include pneumatically closing the port throttle in response to an increased pressure in the vacuum reservoir.

For example, a vacuum consumer may consume the vacuum stored within the vacuum reservoir such that the pressure state of the vacuum reservoir increases. As described above, the vacuum consumer may open to the atmosphere and thus atmospheric air may flow from the vacuum consumer to the vacuum reservoir. In this way, the pressure of the vacuum reservoir may increase. Further, the increased pressure state of the vacuum reservoir may also open a check valve, enabling fluidic communication between vacuum reservoir 152 and region 184, as described above. Therefore, the pressure state of the vacuum reservoir may alter the state of both the pneumatic actuator and the check valve, for example.

In this way, the vacuum consumer may alter the pressure state of the vacuum reservoir. By increasing the pressure state of the vacuum consumer, the pneumatic actuator may be stimulated to close the port throttle and the pressure state of the vacuum consumer may open the check valve between the vacuum reservoir and the intake runner. Thus, airflow from the intake manifold may be largely obstructed and airflow to cylinder 31 may be primarily from the vacuum consumer.

Continuing with method 400, at 404, the method includes generating a vacuum downstream from the port throttle. For example, as described above, a particular cylinder downstream from the port throttle may act as a vacuum pump to generate a vacuum when the port throttle is closed or near closed.

At 406, method 400 includes capturing the vacuum to store within a vacuum reservoir. For example, capturing the vacuum may include pneumatically opening the port throttle in response to a decreased pressure in the vacuum reservoir. Further, the decreased pressure state of the vacuum reservoir may close the check valve, thus inhibiting fluidic communication between the vacuum reservoir and the intake runner. Since the check valve closes due to a decreased pressure state of the vacuum reservoir, the vacuum generated by the cylinder/piston may be captured within the vacuum reservoir.

At 408, method 400 includes supplying the vacuum to a vacuum consumer mechanically actuating a component other than the port throttle. For example, the vacuum stored by the vacuum reservoir may serve as a vacuum source for various vacuum consumers. As described above, a vacuum consumer may consume the vacuum supply within the reservoir, and as a result, may supply a positive pressure to the vacuum reservoir. In this way, the cycle may continue and the pressure state of the vacuum reservoir may actuate the port throttle to generate a vacuum when the vacuum supply is consumed.

It will be appreciated that method 400 is provided by way of example and may include additional and/or alternative steps than those shown in FIG. 4. As one example, method 400 may include adjusting a fuel amount injected into the cylinder downstream from the port throttle when the port throttle is closed or near closed. For example, the fuel amount may be adjusted based up on a reading taken by MAP sensor 182, as described above.

In some embodiments, the cylinder downstream from the port throttle may be optionally fueled. In other words, the cylinder may be dedicated as a vacuum pump cylinder and may not contribute to combustion even when the port throttle is open and the cylinder is supplied with air from the intake manifold, as described above.

Figure 5:
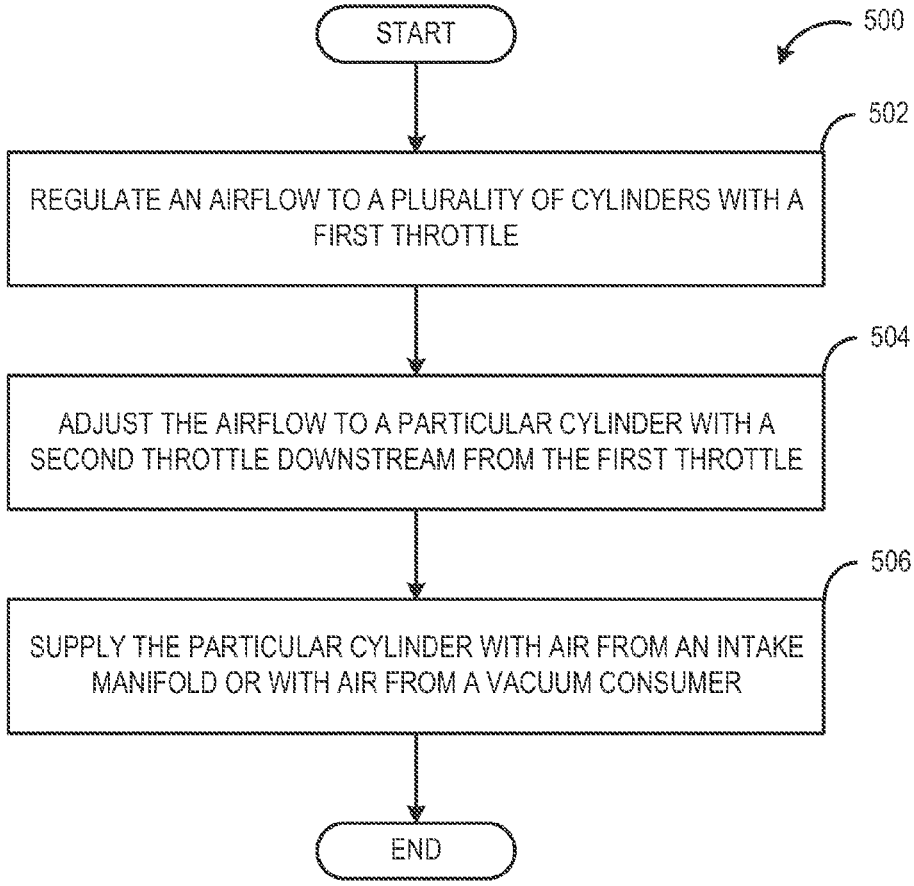
FIG. 5 shows a flowchart of an example method for regulating airflow in the example engine of FIG. 1.

FIG. 5 shows a flowchart of an example method 500 for regulating airflow in the example engine of FIG. 1. As described above, a multi-cylinder engine may include a first throttle (e.g., throttle 62) and a second throttle (e.g., port throttle 108). Further, throttle 62 may be actuated in response to a controller and port throttle 108 may be pneumatically actuated, for example.

At 502, method 500 includes regulating an airflow to a plurality of cylinders with the first throttle. As described above, during operation the plurality of cylinders may undergo a typical four stroke cycle, and thus each of the cylinders may be supplied with air from intake manifold during the intake stroke. The amount of airflow may be regulated by the first throttle, wherein a throttle angle of the first throttle is regulated by a controller in response to vehicle operator input (e.g., electronic throttle control). For example, at wide open throttle the plurality of cylinders may be supplied with a greater amount of air than when the throttle is at a throttle angle less than wide open throttle.

Further, regulating the airflow to the plurality of cylinders with the first throttle may include injecting a fuel amount during an intake stroke of each cylinder. For example, the fuel amount may be injected according to a reading from a first MAP sensor (e.g., MAP sensor 82) upstream from the plurality of cylinders.

At 504, method 500 includes adjusting the airflow to a particular cylinder (e.g., cylinder 31) with a second throttle downstream from the first throttle. For example, adjusting the airflow to the particular cylinder may include adjusting the second throttle via a pneumatic actuator in response to a pressure state of the vacuum reservoir, as described above.

At 506, method 500 includes supplying the particular cylinder with air from an intake manifold or with air from a vacuum consumer. For example, the particular cylinder may be supplied with air from the intake manifold when the second throttle is open. However, when the second throttle is closed the particular cylinder may be supplied with air from the vacuum consumer rather than being supplied with air from the intake manifold. In this way, the source of air supplying the cylinder may be either the intake manifold or the vacuum consumer.

It will be appreciated that the particular cylinder may be supplied with air from both the intake manifold and the vacuum consumer. For example, the port throttle may be near closed and thus may allow some air from the intake manifold to leak around the throttle. Therefore, the region within the intake runner downstream from the port throttle may include air from the intake manifold and air from the vacuum consumer by way of the vacuum reservoir. As such, the particular cylinder may fill with air from both sources.

By adjusting the airflow provided to the particular cylinder from the intake manifold, it is possible to generate a vacuum. For example, when the port throttle is closed a vacuum may be generated downstream from the port throttle, as described above. Further, the vacuum may be stored in a vacuum reservoir and provided to various vacuum consumers, as described above.

It will be appreciated that method 500 is provided by way of example and may include additional and/or alternative steps than those shown in FIG. 5. For example, adjusting the airflow to the particular cylinder may include adjusting the fuel amount to the particular cylinder during an intake stroke of the particular cylinder. For example, the fuel amount may be adjusted according to a reading from a second MAP sensor (e.g., MAP sensor 128) positioned downstream from the second throttle (e.g., port throttle 108). Therefore, depending on the position of the port throttle, a controller may determine if adjusting the fuel amount for the particular cylinder is warranted. In other words, the controller may determine if a reading from MAP sensor 182 and/or MAP sensor 82 should be used to determine a fuel amount to inject into the particular cylinder. Further, it will be appreciated that the controller may determine the position of the port throttle via a throttle position sensor that reports a current position of the port throttle to the controller.

Figure 6:
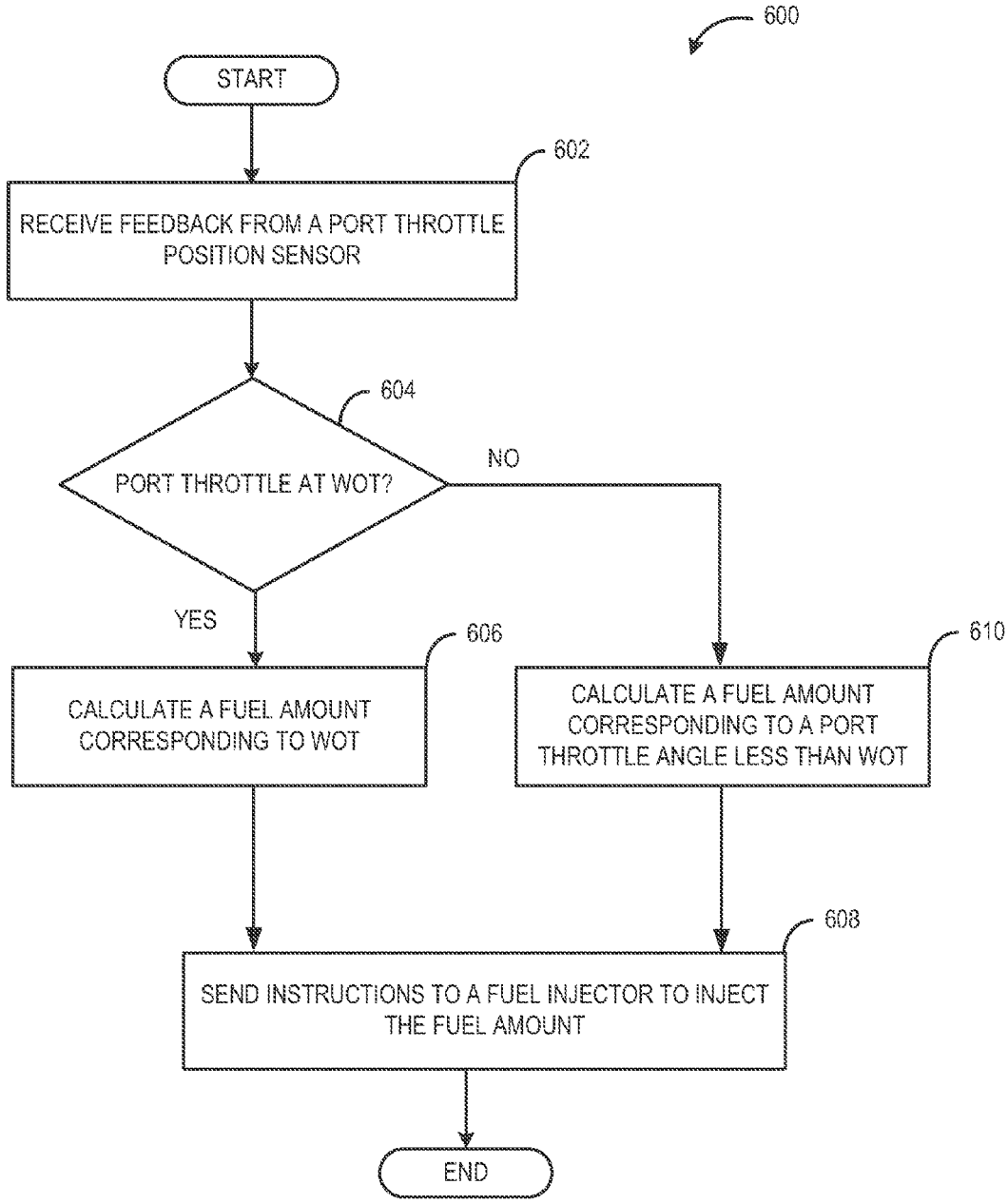
FIG. 6 shows a flowchart of an example method for a controller of the example engine of FIG. 1.

For example, FIG. 6 shows a flowchart of an example method 600 for a controller to determine a fuel amount for a cylinder downstream from a port throttle. As described above, a self-sustaining vacuum system may operate independently from the controller to generate a vacuum; however, various sensors may be positioned within the vacuum system in order to provide feedback to the controller for fuel injection.

At 602, method 600 includes receiving feedback from a port throttle position sensor. Such feedback may include the throttle angle of the port throttle. For example, the controller may receive feedback from the port throttle position sensor (e.g., port throttle position PTP signal of FIG. 1) which may include a current throttle angle for the port throttle.

At 604, method 600 includes determining if the port throttle is at wide open throttle (WOT). If the answer to 604 is YES, method 600 continues to 606.

At 606, method 600 includes calculating a fuel amount corresponding to the port throttle at WOT. For example, the calculation may include a value taken from a primary MAP sensor reading (e.g., MAP sensor 82). Further, calculating the fuel amount for such a cylinder (e.g., combustion cylinder 31) at port throttle WOT may be similar to calculating the fuel amount for other cylinders (e.g., combustion cylinders 30) of the multi-cylinder engine.

At 608, method 600 includes sending instructions to a fuel injector to inject the fuel amount in the cylinder (e.g., combustion cylinder 31) downstream from the port throttle prior to TDC.

If the answer to 604 is NO, method 600 continues to 610. For example, the throttle angle of the port throttle may be less than WOT. As described above, the port throttle may be closed or near closed in order to generate a vacuum downstream from the port throttle.

At 610, method 600 includes calculating a fuel amount corresponding to the port throttle angle which is less than WOT. For example, the calculation may include a value taken from a secondary MAP sensor reading (e.g., MAP sensor 182) positioned downstream from the port throttle. As such, the calculation may be different from the calculation corresponding to the port throttle at WOT. In other words, the calculation may be adjusted from normal engine operating conditions. Thus, such a calculated fuel amount for combustion cylinder 31 may be an adjusted fuel amount as compared to the port throttle at WOT and/or the fuel amount calculations for the other cylinders (e.g., combustion cylinders 30).

From 610, method 600 continues to 608 and the controller sends instructions to the fuel injector to inject the appropriate fuel amount into the cylinder downstream from the port throttle. In this example, the instructions may include the adjusted fuel amount for injection prior to TDC.

It will be appreciated that method 600 is provided by way of example and may include additional and/or alternative steps that those shown in FIG. 6. For example, the controller may calculate a fuel amount based upon other sensor readings, and as such, it is to be understood that the calculation may not be solely determined by the readings taken by the aforementioned MAP sensors. Further, in some embodiments, the controller may calculate a fuel amount using readings from both the primary and secondary MAP sensors (e.g., MAP sensor 82 and MAP sensor 182). As described above, comparing readings from both MAP sensors may be useful for diagnostic purposes.

In this way, an engine may include a vacuum system that is driven pneumatically and without being operated by a controller to provide a vacuum to drive actuators coupled to one or more of a cabin climate control system, a braking system with pneumatic boost, front axle engagement on four wheel drive systems, wastegate valves, compressor bypass valves, intake manifold air control valves, etc. Such an engine advantageously uses at least one cylinder as a vacuum pump additionally or alternatively to using the cylinder as a combustion cylinder. By driving the vacuum system pneumatically, the vacuum system may be self-sustaining such that the system cycles through different pressure states to meet the demands of vacuum consumers, and then replenishes the vacuum supply without additional sensors or a traditional vacuum pump. Therefore, the engine weight as well as manufacturing costs may be decreased.

Further, it will be appreciated that the vacuum system of the present disclosure may be utilized in various different types of engines. For example, the vacuum system may be implemented in a turbo engine, a diesel engine, a hybrid engine, etc.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An engine comprising:

a first throttle upstream from a plurality of cylinders;

a second throttle upstream from one of the cylinders;

a vacuum reservoir in fluidic communication with an intake runner downstream from the second throttle;

a vacuum consumer in fluidic communication with the vacuum reservoir, the vacuum consumer controlled by an actuator; and a pneumatic actuator driven by a pressure state of the vacuum reservoir to adjust the second throttle.

2. The engine of claim 1, wherein the first throttle regulates an airflow to the plurality of cylinders and the second throttle adjusts the airflow to less than all of the plurality of cylinders.

3. The engine of claim 2, further comprising a controller that adjusts a fuel amount to be injected into the one cylinder.

4. The engine of claim 1, wherein the first throttle regulates an airflow to the plurality of cylinders and the second throttle adjusts the airflow to only one cylinder of the plurality of cylinders.

5. The engine of claim 4, further comprising a controller that adjusts a fuel amount to be injected into the only one cylinder.

6. The engine of claim 1, further comprising a check valve enabling unidirectional airflow from the vacuum reservoir to the intake runner downstream from the second throttle.

7. The engine of claim 6, wherein the pneumatic actuator includes a spring return and a diaphragm, the spring return in a resting position when the vacuum reservoir is in a low pressure state.

8. The engine of claim 7, wherein the check valve is closed during the low pressure state, and wherein the check valve is open during a high pressure state of the vacuum reservoir, the high pressure state relatively higher in pressure than the low pressure state.

9. The engine of claim 8, wherein the vacuum consumer supplies air to the vacuum reservoir increasing a pressure level of the vacuum reservoir from the low pressure state to the high pressure state.

10. The engine of claim 6, wherein the pneumatic actuator decreases the throttle angle of the second throttle in response to an increasing pressure, and wherein the pneumatic actuator increases the throttle angle of the second throttle in response to a decreasing pressure.

11. The engine of claim 1, further comprising a first manifold air pressure sensor downstream from the first throttle and upstream from the plurality of cylinders to detect an air pressure in an intake manifold to determine an amount of fuel to supply to the plurality of cylinders and a second manifold air pressure sensor to detect an air pressure in a region downstream from the second throttle and upstream from the one cylinder to determine an amount of fuel to supply to the one cylinder.

12. The engine of claim 11, wherein a source for the airflow to the cylinder downstream from the second throttle includes the vacuum consumer.

13. A method for an engine comprising:

actuating a port throttle via a vacuum generated by the port throttle;

generating the vacuum downstream from the port throttle;

capturing the vacuum to store within a vacuum reservoir; and supplying the vacuum to a vacuum consumer mechanically actuating a component other than the port throttle.

14. The method of claim 13, wherein the port throttle is upstream from only one cylinder, wherein actuating the port throttle via the vacuum generated by the port throttle includes pneumatically actuating the port throttle in response to a pressure state within the vacuum reservoir, and wherein generating the vacuum downstream from the port throttle includes closing the port throttle in response to a high pressure state of the vacuum reservoir.

15. The method of claim 13, further comprising injecting a fuel amount into a cylinder downstream from the port throttle when the port throttle is open.

16. The method of claim 15, further comprising adjusting the fuel amount injected into the cylinder downstream from the port throttle when the port throttle is closed.

17. A method for an engine comprising:

regulating an airflow to a plurality of cylinders with a first throttle;

adjusting the airflow to only a particular cylinder with a second throttle downstream from the first throttle only in a port of the particular cylinder; and supplying the particular cylinder with air from an intake manifold or with air from a vacuum consumer.

18. The method of claim 17, wherein the particular cylinder is supplied with air from the intake manifold when the second throttle is open, and wherein the particular cylinder is supplied with air from the vacuum consumer when the second throttle is closed.

19. The method of claim 18, further comprising generating a vacuum downstream from the second throttle when the second throttle is closed and storing the vacuum in a vacuum reservoir, the vacuum reservoir in fluidic communication with the vacuum consumer and the particular cylinder.

20. The method of claim 19, wherein regulating the airflow to the plurality of cylinders with the first throttle includes injecting a fuel amount during an intake stroke of each cylinder, the fuel amount injected according to a reading from a first manifold air pressure sensor positioned upstream from the plurality of cylinders, and wherein adjusting the airflow to the particular cylinder includes adjusting the fuel amount to the particular cylinder during an intake stroke of the particular cylinder, the fuel amount adjusted according to a reading from a second manifold air pressure sensor positioned downstream from the second throttle.

* * * * *